US006446268B1

(12) United States Patent
Lazarian

(10) Patent No.: US 6,446,268 B1
(45) Date of Patent: Sep. 10, 2002

(54) GARMENT SUPPORT DEVICE

(76) Inventor: Rodica Lazarian, 4140 Megan Rd., Duluth, GA (US) 30096

( * ) Notice: Subject to any disclaimer, the term of this patent is extended or adjusted under 35 U.S.C. 154(b) by 0 days.

(21) Appl. No.: 09/978,269

(22) Filed: Oct. 15, 2001

(51) Int. Cl.[7] ..... R41F 9/02

(52) U.S. Cl. ..... 2/255; 2/238; 2/237; 450/106; 427/256

(58) Field of Search ..... 2/227, 228, 236–238, 2/220, 221, 67, 69, 255, 400–408; 450/100–106, 81, 93, 97, 110–112; 427/256, 284–286, 288; 428/195, 196, 200, 225, 262

(56) References Cited

U.S. PATENT DOCUMENTS 1,706,508 A * 3/1929 Winnett ..... 450/112
1,811,843 A * 6/1931 Chisholm ..... 450/81
2,032,935 A * 3/1936 Hurt ..... 450/81
2,223,621 A * 12/1940 Knappenberger ..... 2/237
2,289,679 A * 7/1942 Porter ..... 2/81
2,561,777 A 7/1951 Bernstein
2,697,230 A 12/1954 Rosecrans
2,837,748 A 6/1958 Manning
3,253,599 A * 5/1966 Bjorn-Larsen ..... 450/112
3,478,748 A * 11/1969 Bjorn-Larsen ..... 450/112
3,496,944 A * 2/1970 Cuozzi ..... 450/112
3,590,390 A * 7/1971 Howard ..... 450/112
3,590,823 A 7/1971 Pope
3,854,978 A * 12/1974 Campbell, Sr. ..... 450/112 X
3,930,090 A * 12/1975 Campbell, Sr. ..... 450/112 X
5,497,513 A 3/1996 Arabeyre
6,059,834 A 5/2000 Springs
6,332,825 B1 * 12/2001 Henricksen ..... 450/81

* cited by examiner

*Primary Examiner*—Gloria M. Hale
(74) *Attorney, Agent, or Firm*—Technoprop Colton LLC

(57) ABSTRACT

A device for supporting a garment having a slip-resistant material impregnated into a support material, wherein selective placement of the device onto a garment increases the friction between garment and the wearer's skin without deforming the contact surface, thus helping to prevent the garment from sliding relative to the wearer's skin.

29 Claims, 7 Drawing Sheets

GARMENT SUPPORT DEVICE

BACKGROUND OF THE INVENTION

1. Technical Field.

The present invention generally relates to support devices for garments and more specifically relates to non-adhesive support devices that can be incorporated onto garments, including dresses, to support such items in place against the wearer's skin or clothing.

2. Prior Art.

For as long as women have been wearing garments (such as dresses), women have been confronted with the problem of keeping such garments in place against the laws of physics. From the natural curvatures of human bodies, garments without support will naturally fall because the human body cannot provide adequate support for such clothing. Specifically, a classic dress that attempts to show off or enhance a person's natural attributes (such as shoulders or cleavage) lacks support for remaining in place and/or can become particularly problematic without supporting straps. However, under certain circumstances, adequate straps are not practical for aesthetic reasons. The only previous solution was for the wearer to routinely pull up and straighten such garments, which can be a torment, or inadvertently allow the garment to fall, which can be embarrassing.

Because maintaining garments in their proper position has been such a problem, the prior art has attempted to provide solutions for keeping garments in place but is not directed at upper body garments such as dresses. For example, U.S. Pat. No. 2,561,777 to Bernstein discloses an antislip pad for use in combination with a garter and stocking, which can be attached to the garter so that it is between the stocking and the leg when the stocking is clipped to the garter. The Bernstein '777 device was developed specifically for stockings and is not feasible for use with other garments.

U.S. Pat. No. 2,697,230 to Rosecrans discloses a stocking clamping garter that comprises a first band of soft rubber that is placed between the stocking and the leg and a second band comprising elastic material that is placed over the stocking and the first band. The first band provides some friction between the stocking and the leg and the second band clamps the stocking between the first band and the second band. The Rosencrans '230 device also was developed specifically for stockings and also is not feasible for use with other garments.

U.S. Pat. No. 2,837,748 to Manning discloses a garment keeper comprising an elastic portion and two clip portions which can frictionally engage another garment (or the skin) to prevent the garment from slipping (or the garment from moving relative to the skin). The Manning '748 device is just a double clip and is not suitable for sewing into a garment, and further is of such proportions that it is not feasible for use with form fitting and shape enhancing garments.

U.S. Pat. No. 3,590,823 to Pope discloses a combination girdle and stockings in which both the lower portion of the girdle and the upper portion of the stockings have a non-slip fabric band. The two bands make a frictional contact with each other to hold the stockings in place and to prevent the girdle from riding up. The Pope '823 device also was developed specifically for stockings and also is not feasible for use with other garments.

Additionally, various slippage-preventing devices have been developed in the field of medical devices. However, the prior art is directed to devices for holding medical support devices in place and is not directed towards garments such as dresses. U.S. Pat. No. 5,497,513 to Arabeyre discloses a medical device for placing pressure on a limb. The Arabeyre '513 device incorporates the use of a non-slip material on the inside of a band on the edge of the device to prevent the device from slipping on the skin. The Arabeyre '513 device was developed for the medical industry and does not translate well for use in the garment industry. U.S. Pat. No. 6,059,834 to Springs also discloses a medical device for placing pressure on a limb. Similar to the Arabeyre '513 device, the Springs '834 device discloses the use of a non-slip material on the inside of a band on the edge of the device to prevent the device from slipping on the skin. The Springs '834 device also was developed for the medical industry and also does not translate well for use in the garment industry.

Notwithstanding the prior art, there is a need for a device that can be sewn onto garments to provide adequate support against the wearer's body or clothing. There also is a need for a support mechanism that can provide garments with the support necessary to maintain the placement of the garments against the wearer's body without deforming the aesthetics of the garment. There further is a need for a device to solve these problems without negative consequences such as leaving marks on the wearer's body. There is an additional need for a device should that can be flexibly positioned onto garments for optimal support of the garment. It is to such needs that the present invention is directed.

BRIEF SUMMARY OF THE INVENTION

The present invention is a device for supporting garments on a wearer. The preferred embodiment of the device is a non-adhesive support device that can be incorporated onto garments, including dresses and undergarments, to support such items in place against the wearer's skin or clothing without compromising the line of the garment or marking or deforming the wearer's skin.

Briefly, the present invention is a slip-resistant device that can be positioned onto the inside of garments to provide support for such items on the wearer. The device preferably comprises two components: a slip-resistant material and a support structure. The preferred support structure is a cloth material, such as lace, and the preferred slip-resistant material is an inert, nontoxic, non-irritating material, such as silicone, impregnated into the support structure.

The slip-resistant device can vary in size and shape with the optimal size and shape dependent on the garment to which it is attached. Preferably, the slip-resistant device is a continuous band or strip that can be cut to the desired length and width, which then can be sewn into position on the garment.

The slip-resistant material of the slip-resistant device has a high coefficient of friction relative to human skin, which effectively prevents garments from sliding downward relative to the skin of the wearer. The slip-resistant material can be silicone, which is generally an inert, non-toxic, and non-irritating material, which is capable of being impregnated into a cloth material. Alternatively, the slip-resistant material can be rubbers, soft plastics, and the like. Also preferably, the slip-resistant material can be applied to a substrate, such as leather, knitted goods, and textile clothing, without harming the garment material.

The slip-resistant material preferably is supported by a cloth material. Lace is one preferred cloth material because of its popularity and elegance, as well as its ability to be impregnated by the slip-resistant material. Alternatively, other cloth, silk or man-made materials can be used. The cloth material should be relatively strong, as it is the support for the slip-resistant material, and must be able to be attached (such as by sewing) to garments. Alternatively, It is contemplated that the slip-resistant material can be the only material of the present invention, and is applied directly to the garment.

The slip-resistant device can be positioned onto garments to provide added additional force to maintain the garment against the wearer's body or clothing. The device can be incorporated as bands, strips, and other shapes. One advantage of the present invention is that it can be made as a continuous band that can be selectively disrupted (cut) to lead to shapes to fit various positions on the garments. The means for incorporating the device onto the garment include sewing, tacking, knitting, weaving, and using an adhesive, and other methods of incorporation will be obvious to the person of ordinary skill in the art.

Therefore, there is a need for a device that can be sewn onto garments to provide adequate additional support against the wearer's body for preventing the garment from slipping. There also is a need for a support mechanism that can provide garments with the support necessary to maintain the placement of the garments against the wearer's body without deforming the aesthetics of the garment. There further is a need for a device to solve these problems without negative consequences such as leaving marks on the wearer's body. There is an additional need for a device should that can be flexibly positioned onto garments for optimal support of the garment. It is to such needs that the present invention is directed.

Other features, aspects, and advantages of the invention will become apparent from the following detailed description of the preferred embodiments, taken in conjunction with the accompanying drawings in which like reference numerals represent like components throughout the several views, illustrating by way of example the principles of the invention.

DETAILED DESCRIPTION OF THE PREFERRED EMBODIMENTS

The present invention in its preferred embodiment is a support device for garments. More specifically, the preferred embodiments are non-adhesive support devices that can be incorporated onto garments, including dresses, to help support such items in place against the wearer's skin or clothing and that can support such item in place without marking or deforming the wearer's skin or adversely affecting the look or line of the garment.

Figure 1:
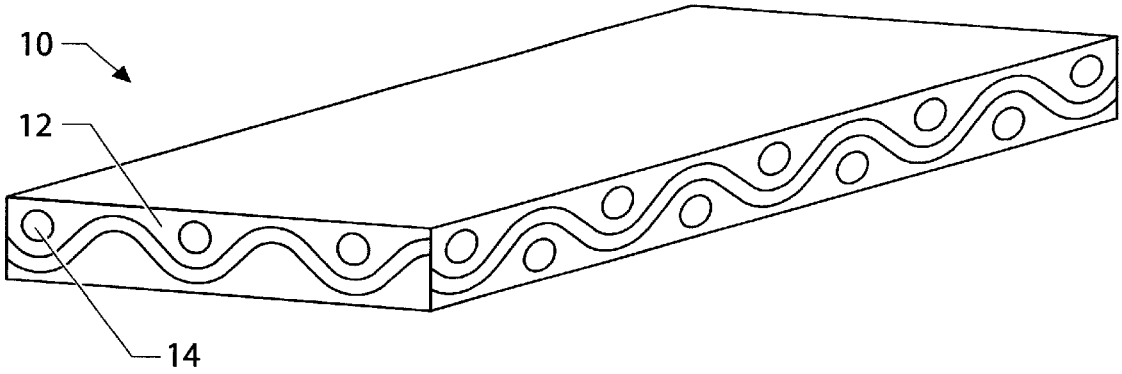
FIG. 1 is perspective view of the slip-resistant device according to the present invention.

Referring now to FIG. 1, one preferred embodiment is a device 10 for supporting a garment 16 upon the wearer's body or clothing. Preferably, the device 10 comprises a slip-resistant material 12 that can be impregnated into, layered onto, or otherwise supported by a support material 14 so as to give the device more structure and strength. The device 10 can be placed in discrete and in selected locations on the garment 16 to prevent slippage of the garment 16 off the contract surface, which can include human skin or clothing.

The slip-resistant material 12 of the slip-resistant device 10 is preferably silicone, but can be other materials such as rubbers, soft plastics, and the like. The preferred slip-resistant materials are skin compatible (defined as a material that does not cause irritation or damage to the skin and does not cause pain in performing its function). Further, the preferred slip-resistant material 12 is non-adhesive (defined as material that does to irreversibly bind to skin or the contact surface). The slip-resistant material 12 preferably is flexible and elastic to a certain degree in at least the x- and y-axis directions, and preferably in all directions, so that it can be adjusted to fit the wearer and/or her clothing without stretching or breaking. Preferably, the slip-resistant material 12 is a material that has a higher coefficient of friction against skin than the garment 16 has against the skin. Further, it can be important to select a slip-resistant material that will not deteriorate quickly from normal use or contact with a surface.

The slip-resistant material 12 preferably is a thin layer of material so as to prevent the deformation of the aesthetics of the garment 16. Preferably, the layer is thick enough to maintain its integrity. It is preferable that the layer be less than 0.2 inches thick, including the support material 14, and more preferable that the layer be between 0.01 to 0.01 inches thick. However, the person of ordinary skill in the art can determine the layer's thickness without undue experimentation, depending on the slip-resistant material's properties and the support material 14.

The support material 14 preferably is a thin and relatively strong material capable of supporting the slip-resistant material and being attached to a garment 16. Laces and cloths are preferred, as these types of materials are commonly used in the garment industry, are comfortable to the wearer, can be made aesthetically pleasing, are relatively strong, and are easily incorporated into the garment 16. For the device 10 as used in women's clothing, and especially in more formal women's clothing, lace is the preferred support material 14 because of its elegance, flexibility, and thinness coupled with strength.

The support material 14 can be provided in just about any dimensions. Although it is preferred that the support material 14 be 0.2 inches thick or less, thicker materials can be used for different applications. For example, for heavier-or heavy-duty garments 16, a thicker support material 14 may be indicated. However, for the normal garment 16, and for more formal garments 16, a thinner support material 14 generally is indicated. Typically, a cloth, cloth-like or lace material being 0.2 inches thick or less, ⅛ inch to 3 inches wide and ¼ inch or more in length is suitable. The support material 14 can have a width less than ¼ inch or greater than 3 inches for certain situations, but it is contemplated that the vast majority of situations will require a width of between ¼ inch and 3 inches. The support material 14 preferably is supplied in an extended length or roll that can be cut to the final length desired. For example, a band of lace or a band of cloth or cloth-like material is a suitable support material 14.

Figure 2:
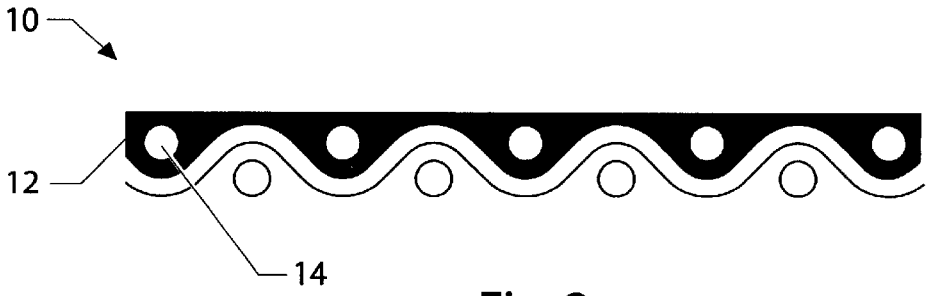
FIG. 2 is cross section of the slip-resistant device in a first embodiment.
Figure 3:
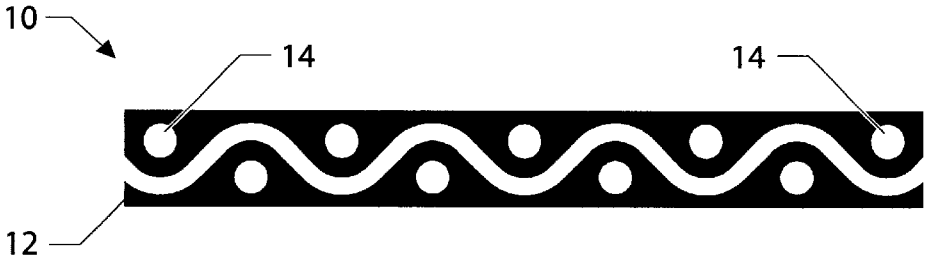
FIG. 3 is cross section of the slip-resistant device in a second embodiment.

Because of the thinness of device and because many slip-resistant materials 12, such as silicone, lack sufficient strength on their own, a support material 14 preferably is integrated with the slip-resistant material 12 to add support and structure. As shown in FIG. 2, the support material 14 can form a substrate on which the slip-resistant material 12 is layered. Alternatively, as shown in FIG. 3, the slip-resistant material 12 can be deeply or completely impregnated into the support material 14. It is contemplated that the support material 14 selected and the means for attaching the slip-resistant material 12 to the support material 14 can be select for primarily aesthetic reasons. It can be optimal to select a pattern for the support material 14 that can hold or reinforce the slip-resistant material 12.

The slip-resistant material 12 can be integrated with the support material 14 by many means. Preferably, the slip-resistant material 12 is impregnated into the support material 14, that is, forced into or onto the support material 14 such that the support material 14 either becomes generally impregnated by the slip-resistant material 12, but with a layer of slip-resistant material remaining on at least one side of the support material 14, or is layered onto the support material 14, also so that a layer of slip-resistant material remaining on at least one side of the support material 14. One method of integrating the slip-resistant material 12 into or onto the support material 14 simply is to coat the support material 14 with the slip-resistant material 12. Many common silicone products come in a relatively fluid state, which can be applied to the support material 14 and allowed to air-cure, forming a dry final product. The slip-resistant material 12 can be forced into the support material 14 by the use of a rolling pin or other flattening devices. Excess slip-resistant material 12 can be removed prior to curing by scraping or subsequent to curing by cutting. Other methods of applying such materials to substrates are known in the art.

A continuous slip-resistant surface on the device 10 is not necessary for suitable functionality. For example, when the device 10 is placed in a garment 16, the wearer may prefer to have more support material 14 than slip-resistant material 12 touch her skin. In fact, a broken surface may reduce chances of the wearer's skin becoming irritated by the device 10 by reducing the surface area of slip-resistant material 12 rubbing against the skin of the wearer. However, because the slip-resistant material 12 essentially supports the garment 16 against the contact surface (the wearer's skin), it is necessary to have sufficient slip-resistant material 12 in contact with the contact surface, so to ensure that the garment 16 is supported adequately against the contact surface.

The means by which the device 10 is incorporated onto the garment 16 can be dependent on the support material 14 used, the slip-resistant material 12 selected, wearer preferences, and tailor preferences, and can be determined without undue experimentation. The layer of slip-resistant material 12 remaining on, or the quantity of slip-resistant material extending outward of, the at least one side of the support material 14, the contact side 18, is the layer contacting the wearer's skin, with the other side of the support material 14, the attachment side 20, contacting the garment 16. The device 10, now comprising the support material 14 impregnated by or layered on the slip-resistant material 12, then is attached to the garment 16 by means of sewing, weaving, knitting, or the like. Alternatively, the device 10 can be adhered to the garment 16 by means of an adhesive-like or bonding means, such as flexible glues or resins. For example, If the material of the garment 16 is leather, it may not be optimal to use stitching technique, but rather to use an adhesive to incorporate the device 10 onto material. Alternatively, if the garment 16 is a material that can be sewn into easily, it may be optimal to sew the device 10 onto the garment 16. The method to incorporate the device 10 onto garment 16 is understood by a person of ordinary skill in the art.

After attachment to the garment 16, as discussed in more detail below with reference to FIGS. 5–8, the slip-resistant device 10 preferably is essentially hidden from the observer of the outside of garment 16. It is understood that the device 10 can be positioned so that the slip-resistant material 14 and device 10 are completely out of sight. Specifically, the slip-resistant device 10 can be overlaid completely by the garment 16 itself, which effectively conceals the slip-resistant device 10. Hence, one advantage of the present invention is that it can add support to garment 16 without compromising the aesthetics of the garment 16.

Further, the device 10 as incorporated into a garment 16 preferably is very supportive, comfortable to wear, and not likely to restrict blood flow. The wearer should not feel the addition of the device 10 onto the garment 16 and the device 10 should not leave marks on the wear's body. Because the device 10 does not add a substantial amount of weight to the garment 16, the user or wearer of the device 10 may not notice the incorporation of the device 10 onto the garment 16

Figure 4:
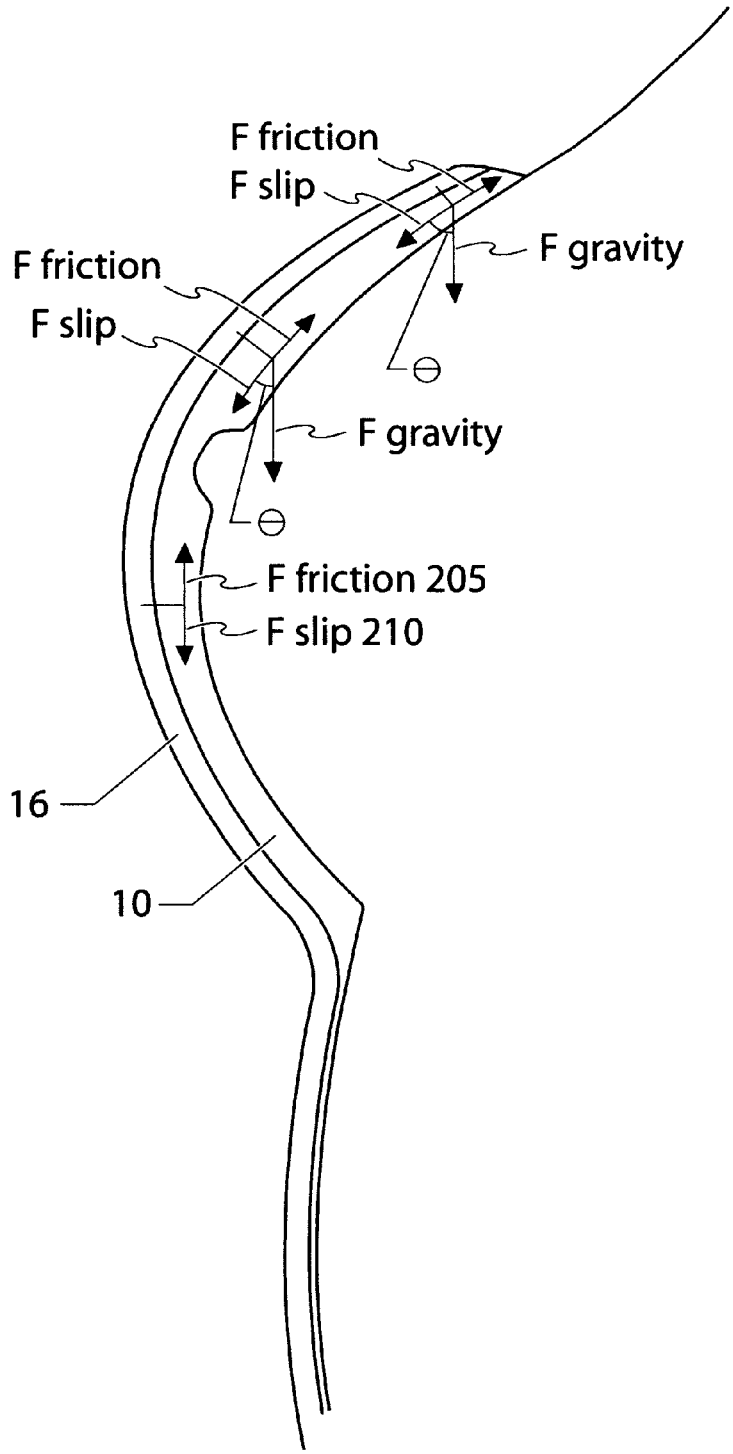
FIG. 4 is a cross section of the invention and a garment on a wearer showing slip and frictional forces.

Referring now to FIG. 4, which illustrates a cross section of a garment 16 against a wearer's body 100 curve, the slip-resistant device 10 helps support the garment 16 against the movement of the wearer's body 100 by enhancing the frictional force between the wearer and the garment 16. Specifically, the frictional force ($F_{friction}$) 205 is enhanced in areas where the support device 10 is placed. The $F_{friction}$ 205 is dependent on the coefficient of friction of the slip-resistant material and on the contact surface. The $F_{friction}$ 205 counters the force acting on the garment 16 ($F_{slip}$) 210 that can cause the garment 16 to slip. The $F_{slip}$ 210 is function of gravity and the garment's 16 position with respect to the contact surface (i.e. angle ○ between the $F_{slip}$ 210 and the force of gravity). A higher coefficient of friction between the slip-resistant material 14 and the contact surface 100 can result in a stronger support mechanism. Further, when the slip-resistant device 10 is incorporated on a garment 16, it increases the frictional force of the garment 16 by elevating $F_{friction}$ 205. Although the slip-resistant device enhances the friction between the garment 16 and the contact surface 100 on the wearer, it allows the garment 16 to move when the wearer makes a major move, such as sits down.

Figure 5:
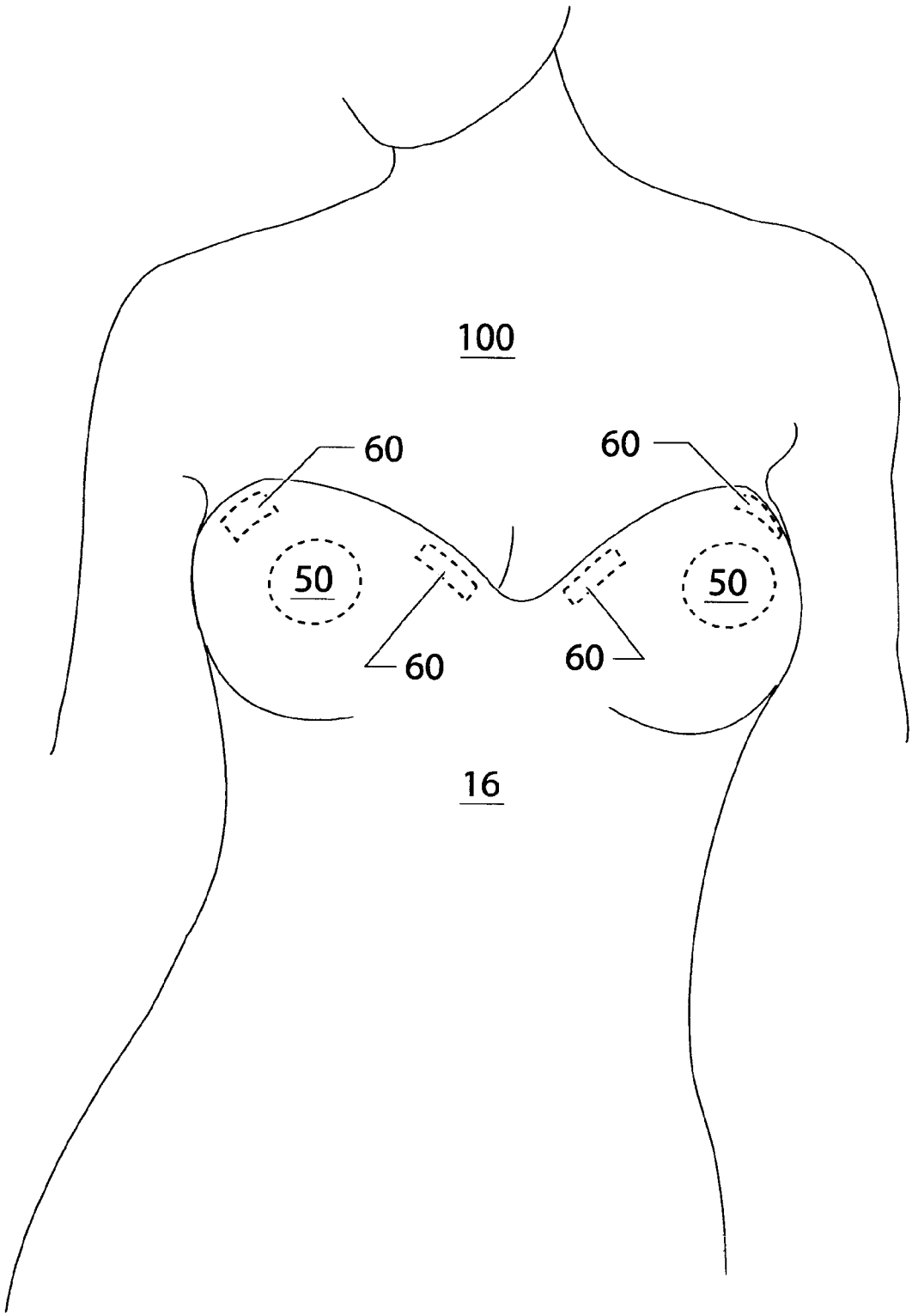
FIG. 5 is a first perspective view of the slip-resistant device on a garment.

Referring now to FIG. 5, the slip-resistant device 10 can be placed onto the inner surface of garment 16 to maximize the frictional forces between the garment 16 and the contact surface 100, which can be the wearer's skin or clothing. FIG. 5 illustrates the flexibility in the positioning of the slip-resistant device 10 on garment 16. The device 10 can be positioned onto garment 16, such as a strapless dress, in manner that optimizes support, aesthetics, and/or the wearer's specifications. One preferred embodiment includes positioning strips 60 of the device 10 at various locations on the garment 16 for optional support and to counter the force of gravity ($F_{gravity}$). Further, the present device 10 can be constructed in various shapes, such as cups 50 or strips 60, for optimal placement and support. The wearer of the device 10 or the tailor can determine and can incorporate shapes of the device 10 that the best support the garment 16.

Figure 6:
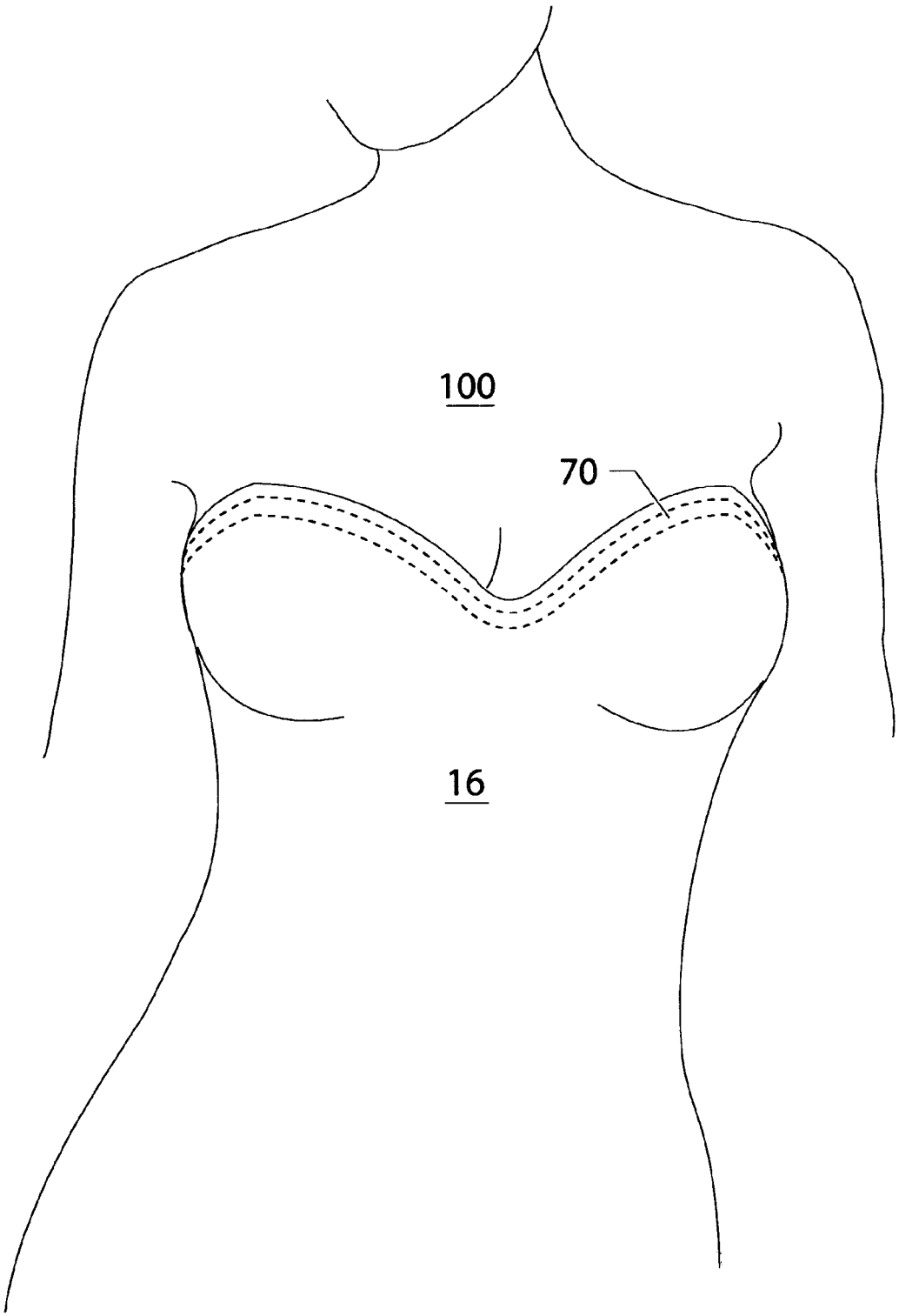
FIG. 6 is a second perspective view of the slip-resistant device on a garment.

In the example shown in FIG. 5, strips 60 of the device 10 are attached to the upper hemline, at or just above the bust, on the inside of the garment 16, and cups 50 of the device 10 are attached within the bra cups of the garment. The strips 60 either can be individual strips 60 strategically located along the hemline, as shown in FIG. 5, or can be a continuous band 70 of the device 10 attached along the entire hemline, as shown in FIG. 6. Likewise, the cups 50 can be of any size as long as they fit within the bra cups. The strips 60 assist in maintaining the upper edge of the garment 16 on the wearer's chest and to prevent the garment 16 from sliding downward on the wearer's body 100 and thus exposing the wearer's chest or breasts. Alternatively or in conjunction with strips 60, cups 50 within the bra cups of the garment 16 perform the same function. Cups 50 contact the wearer's breasts (for women, especially) and both prevent the breasts from popping out of the garment 16 (while dancing, for example) and prevent the garment 16 from sliding downward on the wearer's body 100.

Referring now to FIG. 6, one embodiment of the device 10 can include one or more bands 70, which can be placed around the edges of garment 16, such as a dress, to provide support. This embodiment is especially useful for strapless gowns, in which case the band 70 can be attached to the inside of the upper hemline (bust line) of the garment 16 to prevent the garment 16 from sliding downward on the wearer's body 100. This embodiment also is especially useful for garments 16 having low cut backs, such as ball gowns, in which case the band 70 can be attached to the inside of the upper back hemline of the garment 16 to prevent the garment 16 from sliding sideways about the torso of the wearer, thus exposing the wearer's breasts from the side, and from sliding downward on the wearer's body, thus exposing the wearer's undergarments (pantyhose, girdle or other underwear) or posterior. Strategically placed strips 60 also can be used in place of bands 70.

Figure 7:
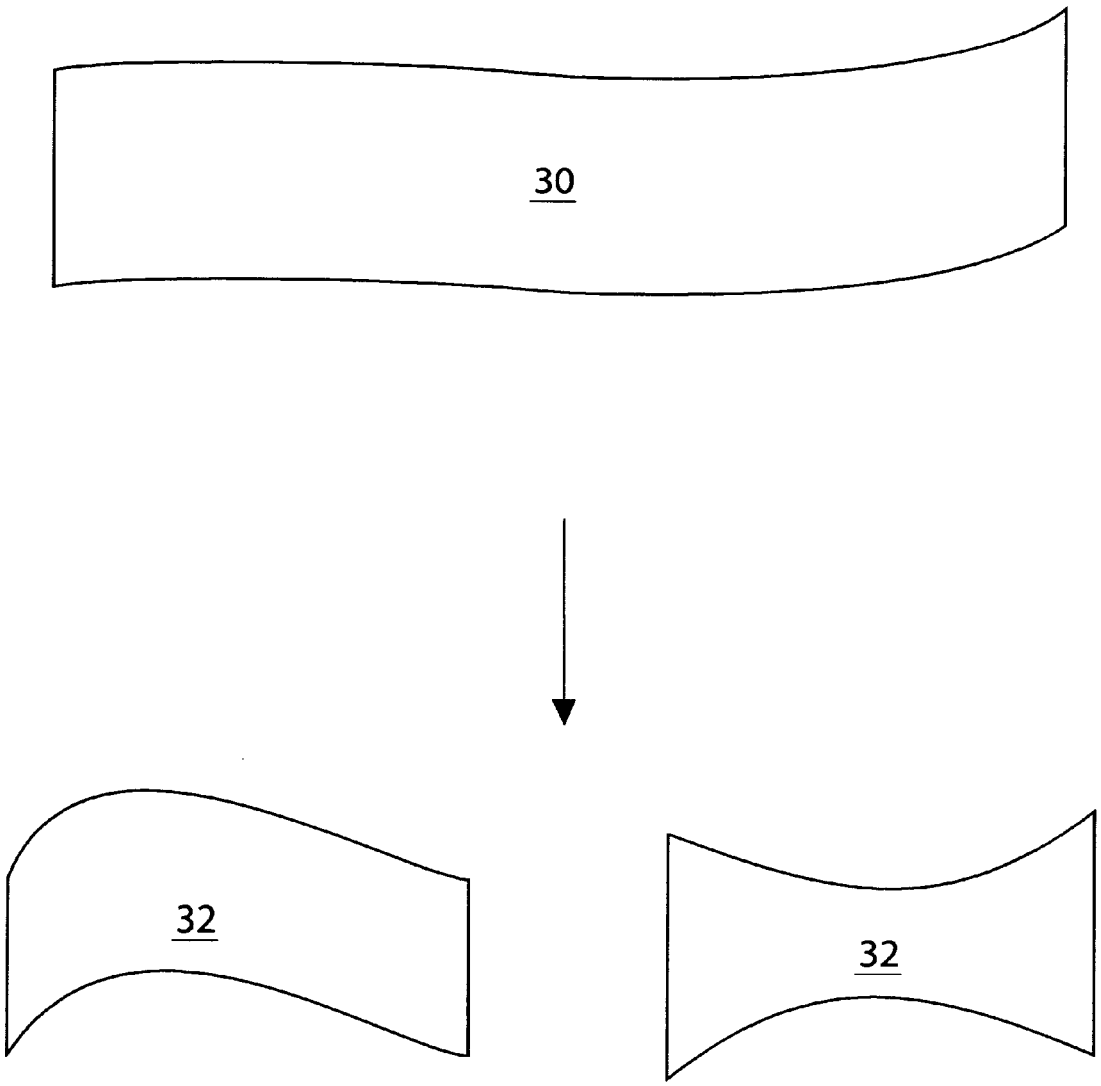
FIG. 7 is a third perspective view of the slip-resistant device on a garment.

As shown in FIG. 7, it is contemplated that the slip-resistant device 10 can be produced as a continuous band 30 of a set length (such as a roll of an impregnated lace band) and selectively disrupted (cut) to produce shapes 32 that are useful for user's specifications. Therefore, if the device 10 is supplied as a roll of support material 14 impregnated by a slip-resistant material 12, the device 10 can be cut to the desired length and width for strategic attachment to the garment 16.

Figure 8:
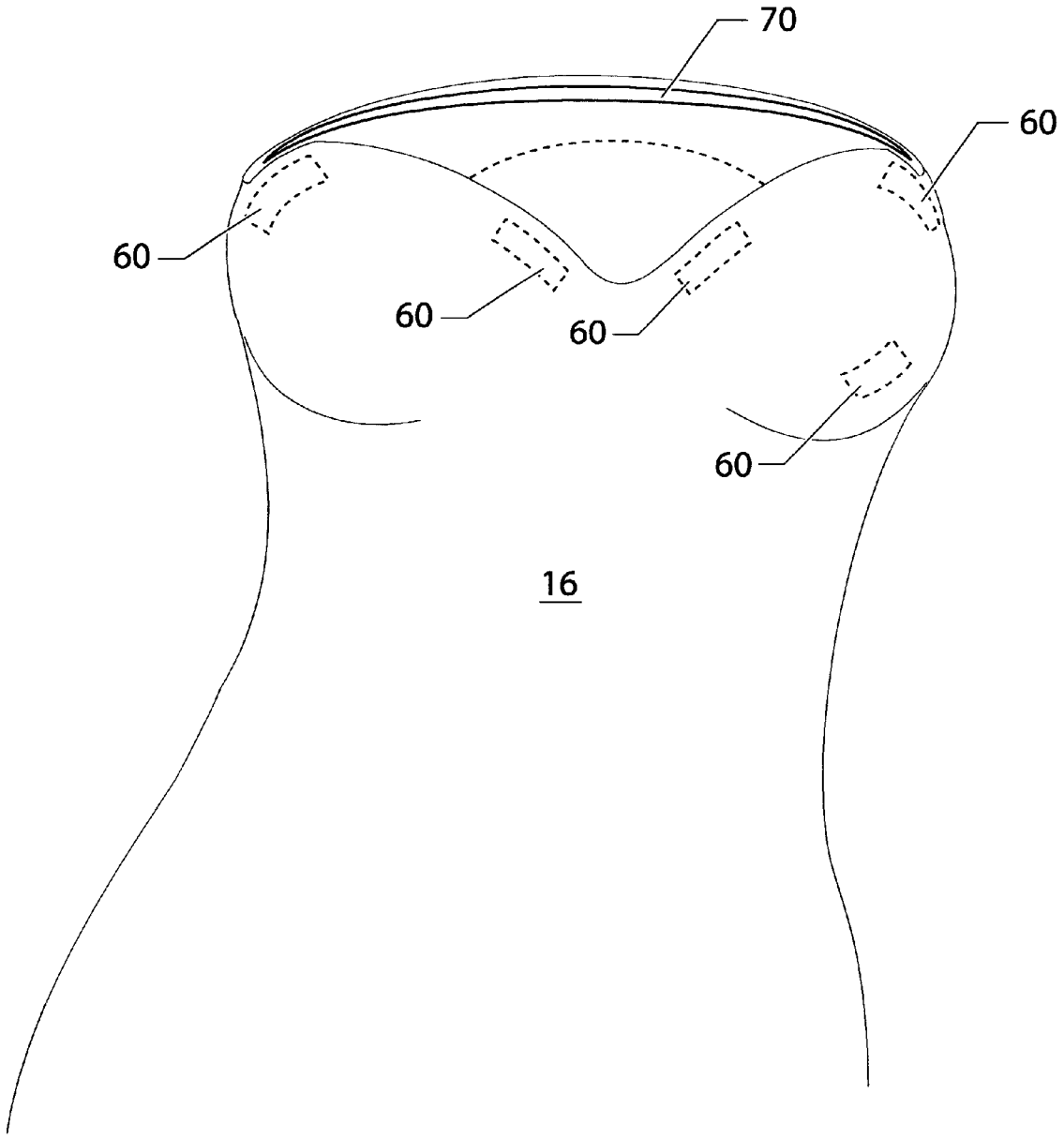
FIG. 8 is a fourth perspective view of the slip-resistant device on a garment.

As shown in FIG. 8, the device 10 can be applied to an array of positions on a garment 16. For example, the device 10 can be applied in band 70, form to the back of a garment 16 and in strip 60 form in the front of a garment 16. Alternatively, the device can be applied in strip 60 form on the back of the garment 16 and in band 70 form on the front of the garment. Alternatively, the device could be applied only to the back of a garment 16 in the form of a band 70. The user will be able to determine the positions and embodiments of the present device 10 that will maximize the frictional forces and the aesthetic needs.

Figure 9:
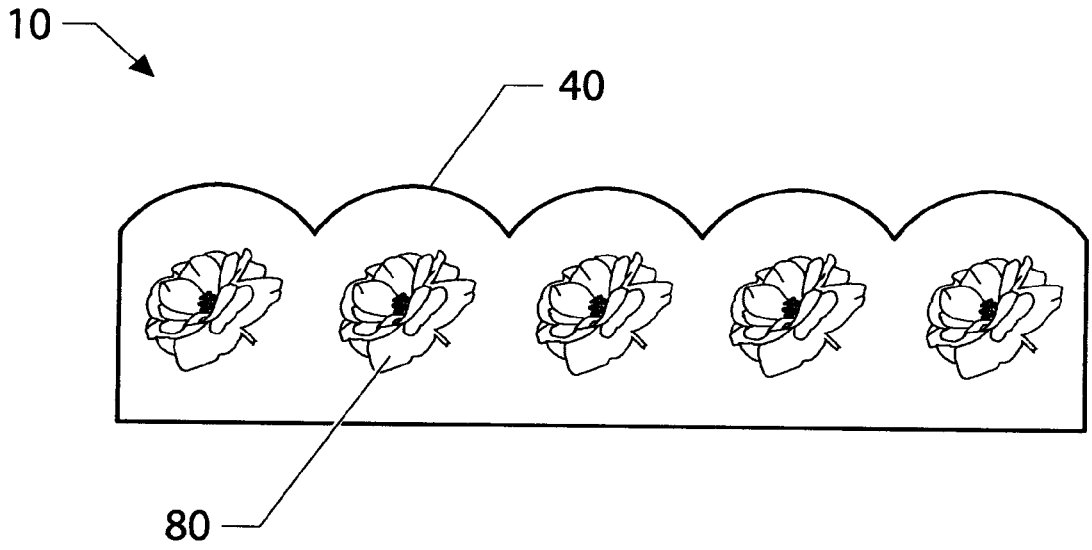
FIG. 9 is perspective view of the slip-resistant device according to a first alternative embodiment of the support structure of the invention.
Figure 10:
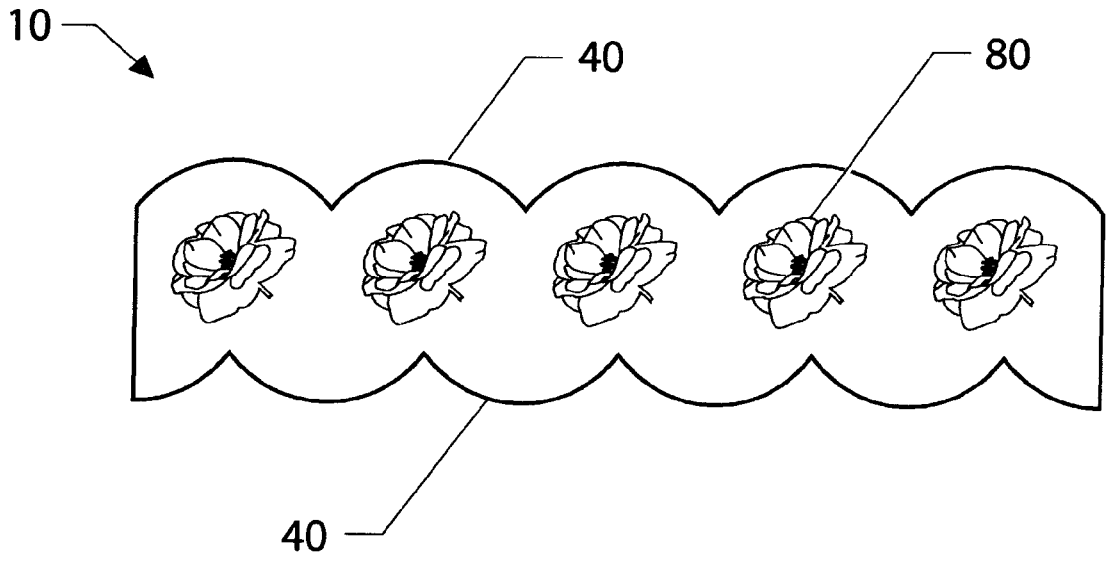
FIG. 10 is perspective view of the slip-resistant device according to a second alternative embodiment of the support structure of the invention.

FIGS. 9 and 10 illustrate preferred first and second alternative embodiments of the device 10. FIG. 9 illustrates the use of a single scalloped lace band 40 having an ornamental flower design 50. This type of lace band is used in the construction of women's clothing and has aesthetic appeal. Further, the single scalloped edge allows the band 40 to be sewn onto a garment 16 and contoured around the edges of the garment 16 without excessive buckling. For example, a straight edged embodiment of the device 10, such as that shown in FIG. 7, is suitable for use on straight hemlines. However, if the embodiment of the device 10 shown in FIG. 7 had to be contoured about a curving neckline, for example, the device 10 may buckle slightly, possibly disrupting the flow or line of the garment 16, or creating a fold that may irritate the wearer's skin or decrease the frictional support of the device 10. The scalloped edge of band 40 helps reduce or prevent such buckling. Likewise, the double scalloped edge shown in FIG. 10 further helps prevent such buckling.

Although the above examples illustrate that the slip-resistant device 10 can be used on a dress, especially the upper front and back edges of a dress, it is evident that the device 10 can be used on an array of garments 16. For example, the device 10 could be incorporated on pantyhose to keep such items in place against the wearer's leg. Additionally, the device 10 could be used on costumes and other clothing that requires additional adhesion for optimal support. Further, the device 10 could be used on other undergarments, such as girdles, corsets, combination girdle/corsets, and just about any other type of garment 16 needing additional support against slippage. It is understood that the person of ordinary skill in the art can use the present device 10 with various items of clothing without undue experimentation.

A second embodiment of the present invention comprises only the incorporation of a slip-resistant material 14 onto a garment 16 without the use of a support material 14. A support material 14 can be unnecessary if the area onto which the present device 10 is sewn is not seen and the person wearing the garment 16 is not opposed to having slip-resistant material 14 directly against her skin. In the second embodiment, the slip-resistant material 14 is impregnated directly into the garment 16, similar to FIG. 3, where the garment 16 is the support material 14, at strategic locations. Alternatively, the slip-resistant material 14 is layered directly onto the garment 16, similar to FIG. 2, where the garment 16 is the support material 14. The second embodiment can be selected with a slip-resistant material 14 that can maintain its integrity without the incorporation of a support material 14.

The above disclosure and representative examples are meant to be illustrative of the invention and not to limit the scope or spirit as defined by the appended claims and their equivalents.

What is claimed is:

1. A device for supporting a garment relative to a contact surface comprising:

a. a slip-resistant material; and b. a support material, wherein the slip-resistant material is impregnated into the support material, the device is in contact with the contact surface, the slip-resistant material has a higher coefficient of friction relative to the contact surface compared to the garment, and the placement of the device onto the garment is selective; and whereby the placement of the device onto the garment increases the friction of the garment with the contact surface.

2. The device as claimed in claim 1, wherein in the slip-resistant material is selected from the group consisting of silicone, rubber, soft plastics, and mixtures thereof.

3. The device as claimed in claim 2, wherein the slip-resistant material is a silicone.

4. The device as claimed in claim 1, wherein:

a. the support material comprises at least two sides, with a first side being a contact side for contacting the contact surface and a second side being an attachment side for attaching to the garment, and b. the device is attached to the garment at the attachment side.

5. The device as claimed in claim 4, wherein the slip-resistant material is impregnated into the entire support material.

6. The device as claimed in claim 4, wherein the slip-resistant material is discontinuously impregnated into the support material.

7. The device as claimed in claim 1, wherein the contact surface is a portion of the wearer's skin.

8. The device as claimed in claim 4, wherein the device is attached to the garment by means selected from the group consisting of sewing, tacking, knitting, weaving, adhesives and combinations thereof.

9. The device as claimed in claim 1, wherein the device is in the shape of a continuous band.

10. The device as claimed in claim 1, wherein the device is in the shape of a strip.

11. The device as claimed in claim 4, wherein the device is positioned completely within the interior of the garment and is contoured to parallel the bustline or neckline of the garment.

12. The device as claimed in claim 11, wherein the device is selectively placed along an upper edge of the interior of garment.

13. The device as claimed in claim 1, wherein the device is longitudinally and axially elastic and flexible.

14. A device for supporting a garment relative to a wearer's skin comprising:

a. a slip-resistant material selected from the group consisting of silicone, rubber, soft plastics, and mixtures thereof; and b. a support material comprising at least two sides, with a first side being a contact side for contacting the wearer's skin and a second side being an attachment side for attaching to the garment, wherein the slip-resistant material is integrated into the support material on at least the contact side, the device is attached to the garment at the attachment side, the device is in contact with the wearer's skin at the contact side, the slip-resistant material has a higher coefficient of friction relative to the wearer's skin compared to the garment, and the device is selectively placed along an edge of the interior of the garment;

whereby the placement of the device onto the garment increases the friction of the garment with the wearer's skin without deforming the garment or irritating the wearer's skin.

15. The device as claimed in claim 14, wherein the slip-resistant material is discontinuously impregnated into the support material.

16. The device as claimed in claim 14, wherein the device is attached to the garment by means selected from the group consisting of sewing, tacking, knitting, weaving, adhesives and combinations thereof.

17. The device as claimed in claim 16, wherein the device is in the shape of a continuous band.

18. The device as claimed in claim 16, wherein the device is in the shape of a strip.

19. The device as claimed in claim 18, wherein the device is longitudinally and axially elastic and flexible.

20. The device as claimed in claim 19, wherein the slip-resistant material is a silicone.

21. A device for supporting a garment relative to a wearer's skin comprising:

a. a slip-resistant material selected from the group consisting of silicone, rubber, soft plastics, and mixtures thereof; and b. a support material comprising at least two sides, with a first side being a contact side for contacting the wearer's skin and a second side being an attachment side for attaching to the garment, wherein the support material is impregnated with the slip-resistant material, the device is attached to the garment at the attachment side, the device is in contact with the wearer's skin at the contact side, the slip-resistant material has a higher coefficient of friction relative to the wearer's skin compared to the garment, and the placement of the device onto the garment is selective; the device is not a waistband, and whereby the placement of the device onto the garment increases the friction of the garment with the wearer's skin without deforming the garment or irritating the wearer's skin.

22. The device as claimed in claim 21, wherein the slip-resistant material is impregnated into the entire support material.

23. The device as claimed in claim 22, wherein the device is attached to the garment by means selected from the group consisting of sewing, tacking, knitting, weaving, adhesives and combinations thereof.

24. The device as claimed in claim 23, wherein the device is in the shape of a continuous band that can be cut to the appropriate length for use.

25. The device as claimed in claim 23, wherein the device is in the shape of a flat sheet that can be cut to the appropriate shape for use.

26. The device as claimed in claim 23, wherein the device is positioned completely within the interior of the garment.

27. The device as claimed in claim 26, wherein the device is selectively placed along an upper edge of the interior of garment.

28. The device as claimed in claim 27, wherein the device is longitudinally and axially elastic and flexible.

29. The device as claimed in claim 28, wherein the slip-resistant material is a silicone.

* * * * *